US009120637B2

(12) United States Patent
Fresnel

(10) Patent No.: US 9,120,637 B2
(45) Date of Patent: Sep. 1, 2015

(54) DEVICE FOR ACCUMULATING FLAT MATERIAL IN FLEXIBLE STRIP FORM

(75) Inventor: Eric Fresnel, Paris (FR)

(73) Assignee: Sleever International Company, Morangis (FR)

( * ) Notice: Subject to any disclaimer, the term of this patent is extended or adjusted under 35 U.S.C. 154(b) by 838 days.

(21) Appl. No.: 13/412,754

(22) Filed: Mar. 6, 2012

(65) Prior Publication Data

US 2012/0228353 A1 Sep. 13, 2012

(30) Foreign Application Priority Data

Mar. 10, 2011 (FR) ..... 11 51982

(51) Int. Cl.
*B65H 20/32* (2006.01)
*B65H 20/24* (2006.01)
*B65H 19/14* (2006.01)

(52) U.S. Cl.
CPC ..... *B65H 20/24* (2013.01); *B65H 19/14* (2013.01); *B65H 20/32* (2013.01); *B65H 2403/60* (2013.01); *B65H 2408/212* (2013.01); *B65H 2408/215* (2013.01); *B65H 2511/12* (2013.01)

(58) Field of Classification Search
CPC ..... B65H 20/30; B65H 20/32; B65H 20/24; B65H 19/14; B65H 2403/60; B65H 2408/212; B65H 2408/215; B65H 2511/12
USPC ..... 226/118.4, 4
See application file for complete search history.

(56) References Cited

U.S. PATENT DOCUMENTS 4,387,843 A 6/1983 Rehklau

FOREIGN PATENT DOCUMENTS

| | | | |
|---|---|---|---|
| CH | 633 230 | A5 | 11/1982 |
| DE | 101 63 762 | A1 | 7/2003 |
| EP | 1 362 814 | A1 | 11/2003 |
| GB | 2249782 | A | 5/1992 |
| JP | 5231502 | A | 9/1993 |
| JP | 2001287859 | A | 10/2001 |

OTHER PUBLICATIONS

French Search Report for Serial No. FR 1151982 dated Nov. 1, 2011.

*Primary Examiner* — William E Dondero
(74) *Attorney, Agent, or Firm* — McCormick, Paulding & Huber LLP

(57) ABSTRACT

The invention relates to a device for accumulating flat material in flexible strip form, the device comprising an accumulator box having a bottom on which the strip accumulates, at least during accumulation stages, between two end walls and between two side walls that extend so as to face edges of the strip. The accumulator device includes at least one of the following means:

- rollers mounted idle close to the bottom and on which the strip rests during accumulation stages;
- air-flow means for establishing a flow of air within the box towards the bottom of the accumulator box;
- vibrator means for vibrating at least one of the side walls; and
- adjuster means for adjusting spacing between the side walls.

5 Claims, 3 Drawing Sheets

DEVICE FOR ACCUMULATING FLAT MATERIAL IN FLEXIBLE STRIP FORM

CROSS REFERENCE TO RELATED APPLICATIONS

This application is entitled to the benefit of and incorporates by reference essential subject matter disclosed in French Patent Application No. 11 51982 filed on Mar. 10, 2011.

FIELD OF THE INVENTION

The invention relates to a device for accumulating flat material in flexible strip form, e.g. a sheath of heat-shrink plastics material for fabricating heat-shrink sleeves on containers or on any other articles.

TECHNOLOGICAL BACKGROUND

In installations for covering containers or other articles in heat-shrink sleeves, it is useful to interpose an accumulator device between the reel carrying a heat-shrink sheath and the station where the sheath is used, with said accumulator device performing several roles. It enables variations in production rates to be absorbed, by avoiding the sheath being pulled too hard. It also enables the reel to be changed while leaving enough time for connecting a new sheath to the end of the old sheath.

Devices are known for accumulating flat material in flexible strip form, which devices comprise an accumulator box into which the strip penetrates and inside which it is laid flat to form a plurality of go-and-return plies. Such an accumulator device nevertheless suffers from certain drawbacks. Some flat materials tend to twist and do not take up spontaneously an arrangement in superposed plies, thereby leading to a shapeless jumble forming inside the box which can jam or damage the strip.

SUMMARY OF THE INVENTION

An object of the invention is to provide an accumulator device of the accumulator box type in which the risk of twisting and of poor positioning of the strip is reduced.

In order to achieve this object, the invention provides a device for accumulating flat material in flexible strip form, the device comprising an accumulator box having a bottom on which the strip accumulates, at least during accumulation stages, between two end walls and between two side walls that extend so as to face edges of the strip, the accumulator device including at least one means for reducing the risk of the strip twisting inside the accumulator box.

According to the invention, the end wall closer to an inlet for the material into the accumulator box carries a deflector suitable for encouraging plies of material to form inside the accumulator box, the deflector being associated with vibrator means for causing the deflector to vibrate.

Associating the deflector with means for vibrating the deflector makes it much easier to cause the material to form flat plies, thereby limiting any risk of the flat material twisting, in particular when the material is a ply of heat-shrink plastics material for fabricating heat-shrink sleeves on containers, where such a material is not of uniform thickness and thus inevitably gives rise to problems when traveling through the accumulator box, with a risk of the sheath twisting that is increased in comparison with a flat material that is of uniform thickness. The invention is thus particularly adapted to limiting twisting in such a sheath.

In a preferred embodiment, the means for reducing the risk of the strip twisting inside the accumulator box are selected from:

- rollers mounted idle, at least in the vicinity of the bottom, and on which the strip comes to rest during accumulation stages;
- air-flow means for establishing a downward flow of air inside the accumulator box;
- vibrator means for vibrating at least one of the side walls; and
- adjuster means for adjusting spacing between the side walls.

Various tests have shown that using one or more of these means makes it possible to further decrease the risk of the strip twisting inside the accumulator box.

BRIEF DESCRIPTION OF THE FIGURES

The invention can be better understood in the light of the following description of particular embodiments of the invention given with reference to the figures of the accompanying drawings, in which.

DETAILED DESCRIPTION OF THE INVENTION

Figure 1:
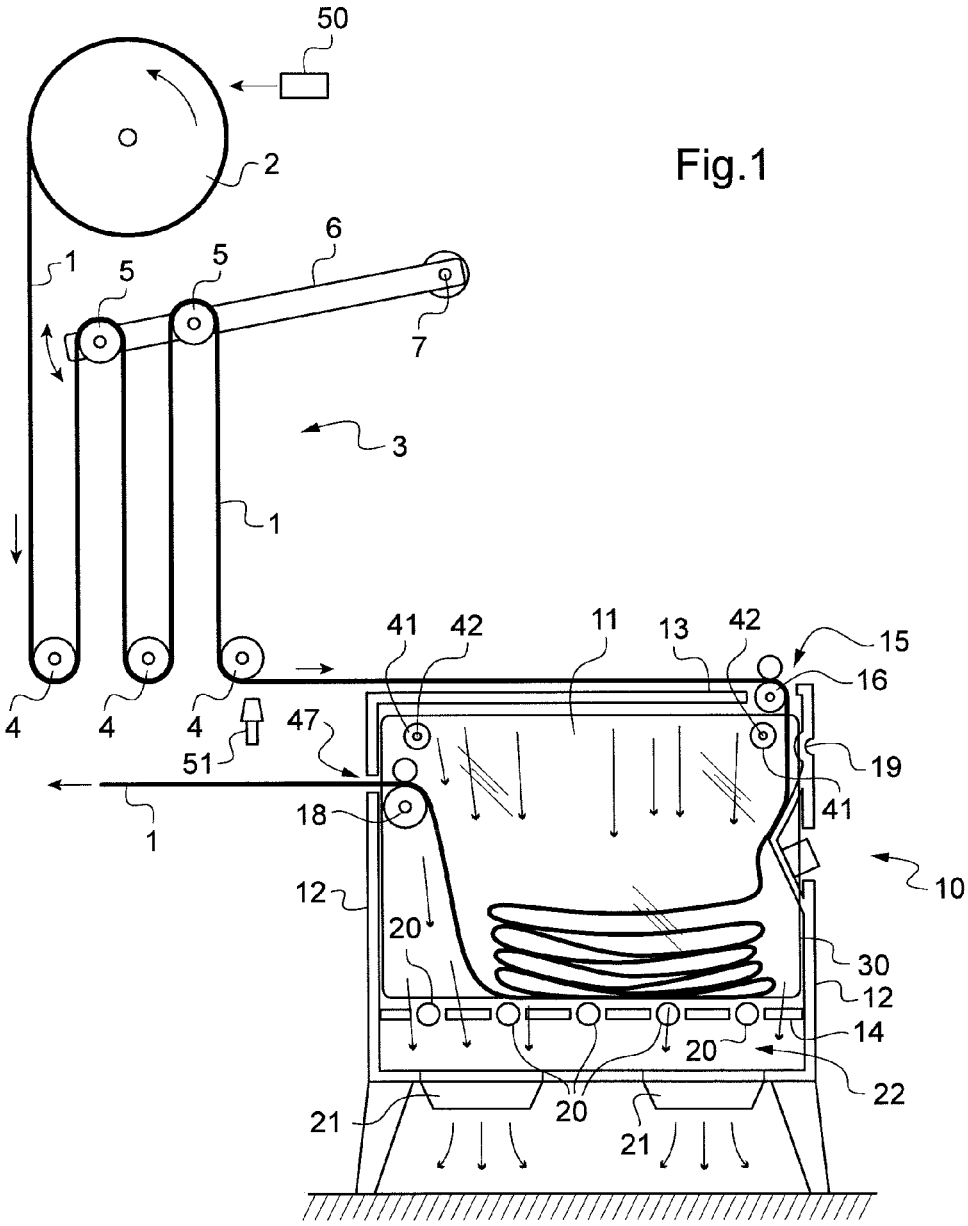
FIG. 1 is a diagram of a circuit for flat material in strip form incorporating an accumulator device in a first particular embodiment of the invention, the box being partially cut away to show its inside.
Figure 2:
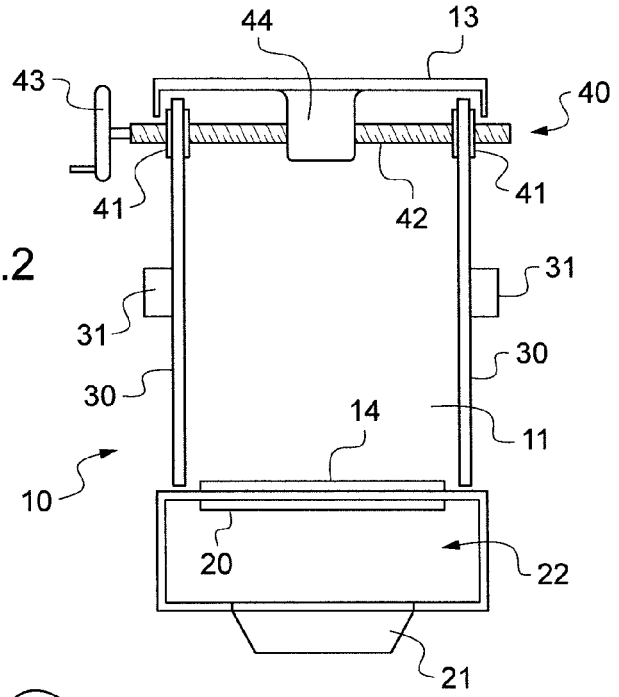
FIG. 2 is an end view of the accumulator box of the accumulator device, one of the end walls being removed.
Figure 3:
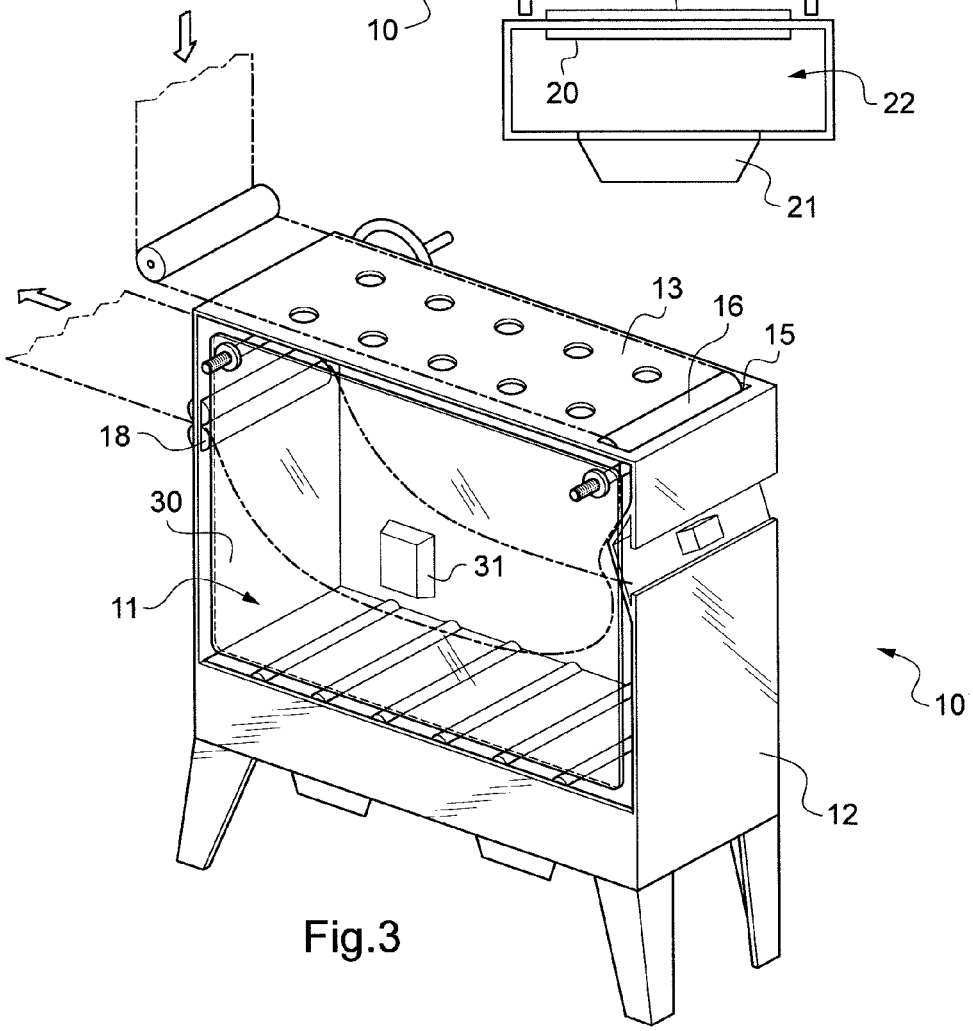
FIG. 3 is a perspective view of the accumulator device of FIGS. 1 and 2.

In a first particular embodiment shown in FIGS. 1 to 3, the accumulator device of the invention is for inserting in an installation that organizes the travel of a flat material in strip form, e.g. a sheath of heat-shrink plastics material. The circuit includes a reel 2 forming a source of strip material 1. The strip 1 is then engaged in a damper device 3 having jumping rollers, comprising a series of stationary rollers 4 and a series of movable rollers 5 mounted on a lever 6 hinged on a pivot 7, with the strip 1 extending between the rollers. The strip 1 is then taken towards an accumulator device 10 of the invention.

The device comprises an accumulator box 11 with the edges of the end wall 12, of the ceiling 13, and of the bottom 14 being shown in the figure. The accumulator box 11 is also closed by two side walls 30 that can be seen end-on in FIG. 2. In this example, the strip 1 enters into the accumulator box 11 via an opening 15 formed through the ceiling 13, the strip being guided by a motor-driven inlet roller 16. The strip leaves the box via an opening 17 formed in one of its end walls 12, being guided by a motor-driven outlet roller 18.

Naturally, the inlet and outlet rollers 16 and 18 are associated with backing rollers for pinching the strip 1 and forcing it to advance. In this example, an antistatic bar 19 is arranged at the inlet of the accumulator box 11 to prevent any static electricity accumulating in the accumulator box, since that might disturb stacking of the plies of the strip one on another.

In a variant, the backing roller for the inlet roller 16 may be designed to be of the antistatic type.

The speed of rotation of the outlet roller 18 is naturally adapted to the rate at which the strip is required by the sleeving machine arranged downstream from the accumulator box 11. The speed of rotation of the inlet roller 16 is normally adjusted to be identical to the speed of the outlet roller 18, except during accumulation stages in which it is faster than the speed of the outlet roller 18, thereby causing the strip to accumulate in plies inside the accumulator box 11, as shown. During such a stage, the strand of strip leaving the accumulator box comes from a portion of the strip 1 that lies under the plies that have been built up by the strip 1. Naturally, FIG. 1 is diagrammatic, and the accumulator device 11 may have tens or even hundreds of plies forming inside the accumulator box 11. It should be observed that the plies are placed one on another without any twisting by virtue of arrangements that are described in detail below.

The assembly operates as follows. During normal operation of the installation, the strip 1 is unreeled progressively from the reel 2 at the speed determined by the machine downstream from the accumulator device. The strip 1 then passes through the accumulator box 11 without building up heat. If, as a result of a level indicator 50 arranged close to the reel 2, it is detected that the reel will soon be completely emptied, the inlet roller 16 is caused to rotate more quickly than the outlet roller 18 so that the strip is progressively accumulated in the accumulator box 11. Once the reel has been completely emptied, an end-of-strip sensor 51 arranged upstream from the accumulator box 11 identifies the end of the strip, thereby causing the inlet roller 16 to be stopped. The end of the strip is then held stationary substantially above the accumulator box 11 where there is a splicing table (not shown). While the previously-accumulated strip is being delivered from the accumulator box 11, an operator removes the empty reel and replaces it with a full reel. The start of the new strip is fed through the damper device 3 until it comes close to the end of the old strip. The operator then proceeds to splice the two strips together, and once they have been spliced together, the inlet roller 16 is once more set into rotation. The quantity of strip that is accumulated in the accumulator box 11 is adjusted to leave the operator sufficient time to change the reel and to splice the new strip to the old strip, with account being taken of the travel speed of the strip at the outlet from the accumulator box.

All of the above-mentioned rollers have axes of rotation that are parallel and that extend perpendicularly to a travel direction of the strip 1 (and thus also perpendicular to the side walls 30).

The arrangements of the invention relate more particularly to eliminating as much as possible, and in any event to reducing, the risk of the strip becoming twisted or poorly positioned inside the accumulator box 11.

According to an aspect of the invention, the bottom 14 of the accumulator box 11 carries idler rollers 20 on which the strip 1 comes to rest during the accumulation stages. The idler rollers 20 make it easier for the strip to be extracted via the opening 17 by preventing it from being braked excessively by the weight of the accumulated plies of strip on top of the exiting strand. Naturally, the axes of rotation of the idler rollers 14 are parallel to the axes of rotation of the other rollers.

According to another aspect of the invention, the accumulator box 11 is fitted with air-flow means for encouraging proper positioning of the plies of strip inside the accumulator box 11 during accumulation stages. The air-flow means here comprise air extractors 21 that establish reduced pressure inside a compartment 22 arranged under the bottom 14 of the accumulator box 11. The bottom 14 of the accumulator box 11 is perforated so that the suction as established in this way causes air to flow downwards inside the accumulator box 11 (i.e. towards the bottom of the accumulator box), as represented by arrows in FIG. 1, thereby tending to press the plies of the strip 1 against one another, and thus make it easier for them to stack up inside the accumulator box 11. Naturally, it is appropriate to provide orifices in the ceiling 13 making air intake possible.

According to yet another aspect of the invention that can be seen more particularly in FIG. 2, the side walls 30 are provided with vibrators 31 serving to cause the side walls 30 to vibrate while the strip 1 is accumulating inside the accumulator box 11. The vibration of the side walls 30 prevents the edges of the strip 1 from catching on the side walls, where that can lead to the strip 1 becoming twisted. Preferably, the side walls 30 are made of transparent material so as to make it possible to verify that the strips of ply 1 are properly stacked inside the accumulator box 11.

According to yet another aspect of the invention, the side walls 30 are associated with adjustable spacer means 40 enabling the distance between the faces of the facing side walls to be adjusted so that the distance matches the width of the strip 1, while leaving a small amount of clearance (typically a few millimeters for a strip having a width of ten centimeters). Each of the side walls 30 in this example is mounted on two supports 41 that co-operate via screw-and-nut type connections with respective shafts 42 (only one of which is visible in FIG. 2) so as to rotate in a manner that is synchronized, e.g. by means of a belt. Each shaft 42 is received to rotate in a bearing 44 secured to the ceiling 13 of the box and is threaded with oppositely-handed threads at opposite ends such that rotating a shaft causes the two side walls 30 to move apart or towards each other symmetrically relative to a midplane along which the strip travels. For this purpose, one of the shafts 42 is fitted with a handle 43 for driving it. The side walls 30 are thus suspended from their supports 41, thereby making them easier to vibrate by means of the vibrators 31.

The arrangements of the invention serve to reduce the risk of the strip twisting in the accumulator box. The Applicant has been able to verify that the accumulator device is suitable for sheaths made of looped heat-shrink plastics material for use in fitting heat-shrink sleeves, with the sheaths being of various thicknesses (20 micrometers to 150 micrometers), and being made of various materials (polyvinyl chloride (PVC), polyethylene terephthalate (PET), oriented polystyrene (OPS), . . . ) traveling at speeds that are suitable for installing 20 to 600 sleeves per minute, the sleeves having heights in the range 15 millimeters to 250 millimeters. No twisting was observed.

Figure 4:
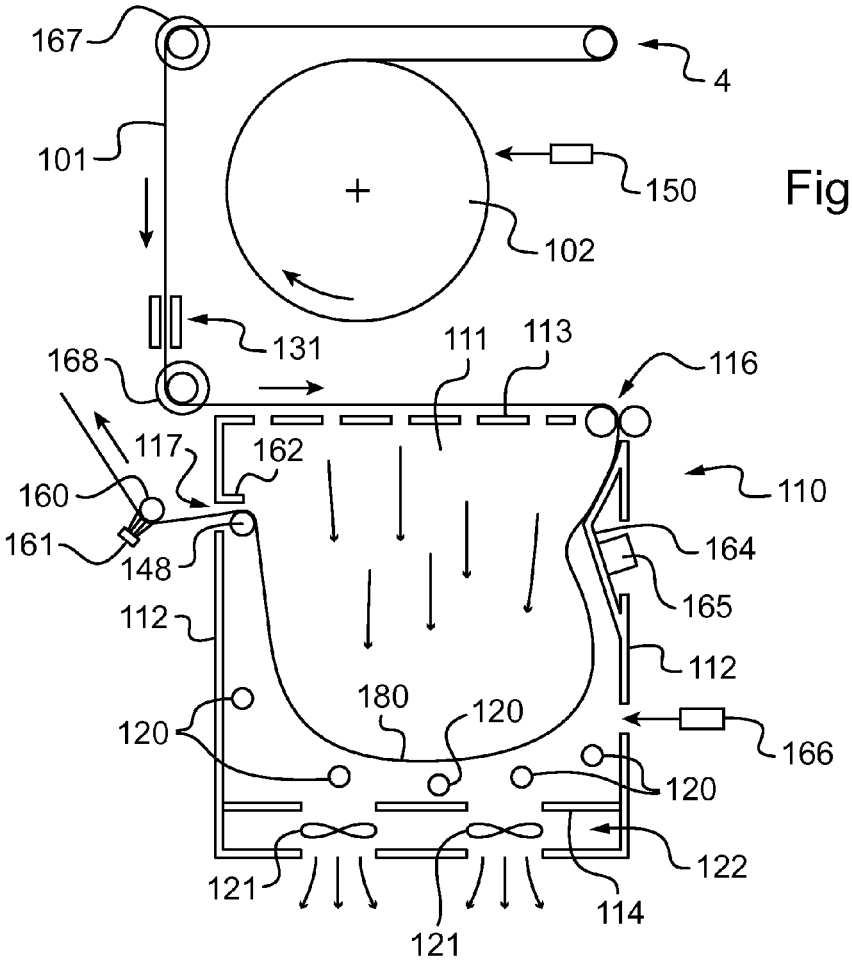
FIG. 4 is a figure analogous to FIG. 1 showing a diagram of a circuit for flat material in strip form incorporating an accumulator device in a second particular embodiment of the invention, during a stage of normal operation of the circuit.
Figure 5:
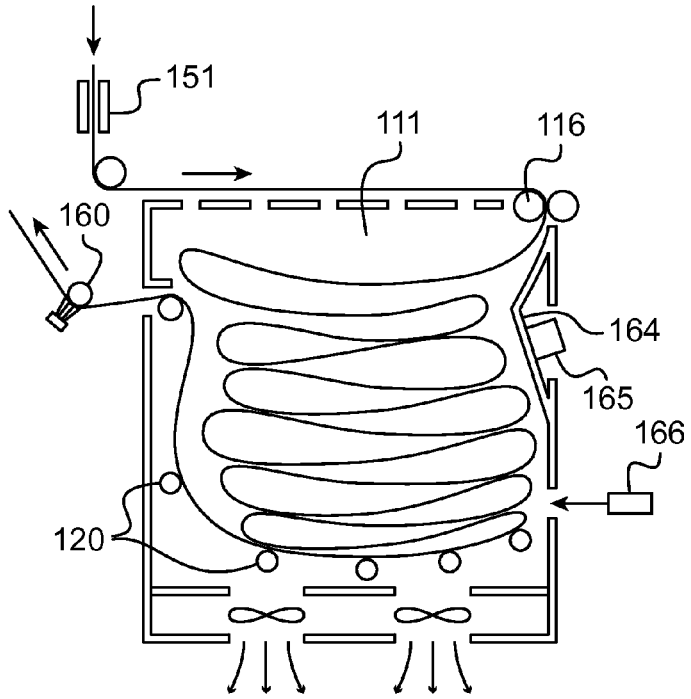
FIG. 5 is a figure analogous to FIG. 4 showing the same circuit for flat material in strip form during a stage of material being accumulated in the accumulator box.

In a second particular embodiment of the invention as shown in FIGS. 4 and 5, in which elements that are common with the embodiment described above have the same references plus one hundred, the strip 101 is taken to an accumulator device 110 that comprises an accumulator box 111, with the edge faces of its end walls 112, its ceiling 113, and its bottom 114 being shown. The accumulator box 111 is also closed by two side walls that are not shown, with at least one of them being transparent. The strip 101 enters into the accumulator box 111 via an opening 115 formed in the ceiling 113, being guided by a motor-driven inlet roller 116 associated with a backing roller. The strip leaves via an outlet 117 formed in one of the end walls 112, being guided by an outlet roller 118.

In this embodiment, a motor-driven extractor roller 160 is arranged on the outside for extracting the strip from the box 111, the motor-driven roller 160 being associated with a brush 161 for maintaining constant tension at the outlet from the accumulator device. Furthermore, a choke 162 is arranged facing the outlet roller 118 to prevent a plurality of plies of strip exiting simultaneously.

The idler rollers 120 on which the strip rests can clearly be seen. In this embodiment, the idler rollers 120 are arranged not only close to the bottom 114, but also along an outlet strand of the strip so as to facilitate exit of the strip, and air-flow means 121 can also be seen for establishing a vertical flow of air through the accumulator box 111.

According to the invention, the end wall 112 opposite from the end wall having the outlet roller 118 is provided in this embodiment with a deflector 164 suitable for causing the strip to be put into plies, which deflector 164 is provided with a vibrator 165 for causing it to move so as to cause the plies to move towards the outlet of the accumulator box 111.

In addition, the accumulator device is fitted with a level sensor 166 for managing some minimum level of plies within the accumulator box during an accumulation stage. The level sensor 166 serves to manage the speed of the inlet roller 116.

The path followed by the strip upstream from the accumulator device 110 includes a reel 102 forming a source of strip 1. The strip 1 is taken to the inlet of the accumulator box 111 by means of cylinders 167 and 168 forming air cushions and fitted with lateral guide rings for assisting in recentering the strip, in particular when using reels onto which the strip has been rewound. There can be seen the end of strip sensor 151 which is located in this embodiment immediately upstream from the deflector cylinder 168, and also the level sensor 150 for sensing the amount that remains on the reel 102.

The device of FIGS. 4 and 5 is used as follows.

In normal operation, as shown in FIG. 4, i.e. when the level sensor 150 has not detected that the strip 101 will shortly cease to be delivered from the reel 102, a slack portion 180 of strip is formed inside the accumulator box 111 by acting on the speeds of rotation of the inlet roller 116 and of the extractor roller 160. For this purpose, it suffices on a temporary basis to cause the inlet roller to rotate faster than the extractor roller so as to generate said portion of strip that makes it possible to accommodate variations in the rate at which the strip is drawn out downstream from the accumulator device of the invention, but without thereby forming plies inside the accumulator box, in order to avoid any risk of the strip twisting.

This thus produces the same damping effect as in the above-described embodiment, but without using an external damper device.

During an accumulation stage as shown in FIG. 5, which stage is triggered when the level sensor 150 detects that the reel 102 will shortly be empty, plies are built up inside the accumulator box, as described above. The vibrating deflector 164 makes it easier to form plies by sending the strip towards the other end wall 112.

The invention is naturally not limited to the above description. In particular, although the means of the invention as described are implemented in combination with one another, the invention also applies to embodiments in which at least one of said means is implemented.

Furthermore, some of the means shown in only one of the particular embodiments described may naturally be mounted on the other described embodiments, or on other variant embodiments of the invention.

Furthermore, said means may be varied in numerous ways. For example, although both side walls as described are fitted with a respective vibrator, it may suffice to vibrate only one of the walls. Similarly, although the spacer means cause the side walls to move symmetrically relative to a midplane, it is possible for only one of the side walls to be moved, providing the installation includes means for centering the strip in the space as defined in that way.

It is clear that the appropriateness of using a damper device (a jumping roller device as described above, or any other damper device), whether arranged upstream of the accumulator device or downstream therefrom, naturally depends on specific circumstances and on the characteristics of the installation.

While the present invention has been illustrated and described with respect to a particular embodiment thereof, it should be appreciated by those of ordinary skill in the art that various modifications to this invention may be made without departing from the spirit and scope of the present.

What is claimed is:

1. A device for accumulating flat material in flexible strip form, the device comprising an accumulator box having a bottom on which the strip accumulates, at least during accumulation stages, between two end walls and between two side walls that extend so as to face edges of the strip, the accumulator device including at least one means for reducing the risk of the strip twisting inside the accumulator box, wherein the end wall closer to an inlet for the material into the accumulator box carries a deflector suitable for encouraging plies of material to form inside the accumulator box, the deflector being associated with vibrator means for causing the deflector to vibrate.

2. The device according to claim 1, wherein said means for reducing the risk of the strip twisting inside the accumulator box are selected from:

rollers mounted idle, at least in the vicinity of the bottom, and on which the strip comes to rest during accumulation stages;

air-flow means for establishing a downward flow of air inside the accumulator box;

vibrator means for vibrating at least one of the side walls; and adjuster means for adjusting spacing between the side walls.

3. The accumulator device according to claim 2, wherein the air-flow means comprise at least one air extractor arranged to establish suction in a compartment arranged under the bottom of the accumulator box, the bottom being perforated to allow air inside the accumulator box to flow towards the bottom thereof.

4. The accumulator device according to claim 2, wherein the vibrator means comprise at least one vibrator directly secured to one of the side walls.

5. An installation for moving material in flat strip form, the installation including an accumulator device according to claim 1 associated with a damper device arranged upstream or downstream therefrom and adapted to accommodate variations in the rate at which strip is taken downstream from the damper device.

* * * * *